United States Patent [19]

Matukura et al.

[11] 4,441,621

[45] Apr. 10, 1984

[54] PIERCEABLE CLOSURE MEMBER FOR VIAL

[75] Inventors: Yoshiharu Matukura, Ikoma; Denpei Sudo, Sumida, both of Japan

[73] Assignees: Takeda Chemical Industries, Ltd., Osaka; Daikyo Gomu Seiko, Ltd., Tokyo, both of Japan

[21] Appl. No.: 408,717

[22] Filed: Aug. 16, 1982

[30] Foreign Application Priority Data

Aug. 24, 1981 [JP] Japan ..... 56-125792[U]

[51] Int. Cl.[3] ..... B65D 39/00

[52] U.S. Cl. ..... 215/247

[58] Field of Search ..... 215/247, 248, 249

[56] References Cited

U.S. PATENT DOCUMENTS

| | | | |
|---|---|---|---|
| 3,392,859 | 7/1968 | Fischer | 215/247 |
| 3,552,591 | 1/1971 | Wimmer | 215/247 |
| 3,760,969 | 9/1973 | Shimamoto et al. | 215/247 |

*Primary Examiner*—Donald F. Norton

*Attorney, Agent, or Firm*—Wenderoth, Lind & Ponack

[57] ABSTRACT

A pierceable closure member for use on a vacuum-filled vial, including a rubber plug having an annular leg and an annular protrusion, and a lamina having an annular recess and secured to the rubber plug with the annular recess receiving therein the annular leg. For the purpose of retaining the vacuum inside the vial, the annular protrusion on the rubber plug has a specific dimensional relationship to the other parameter of the closure member.

6 Claims, 7 Drawing Figures

PIERCEABLE CLOSURE MEMBER FOR VIAL

BACKGROUND OF THE INVENTION

The present invention generally relates to a closure member for a container and, more particularly, to a pierceable closure member for a medical bottle such as a vial.

In any country where the medical administration is more or less advanced, standards for medical supplies are naturally strict with no exception to the quality of a closure member for a medical bottle which contains therein a medicament, either solid or liquid, including, for example, an injection solution and a medical powder to be subsequently dissolved by injecting a liquid into the bottle. In other words, the closure member for use on the medical bottle should have, and is required to have, a relatively high quality so that the medicament contained in the bottle will not be contaminated by the dissolution of, in reaction with or in contact with material and/or additives used during the manufacture of the closure member. Once the medicament has been contaminated in any way, some or all of the pharmaceutical characteristics, for example, potency, color, clarity, activity and pH value, of the medicament will be adversely affected.

To avoid the above discussed problem, various proposals have hitherto been made to improve the closure member of the type referred to above. Of them, a closure member coated in part or in whole with a film of chemically stable material, such as fluorocarbon resin or Teflon (Du Pont's Reg. Trademark) has largely been accepted because of its chemical performance superior to that afforded to any other coating materials. This is exemplified by the U.S. Pat. No. 3,198,368, patented Aug. 3, 1965, U.S. Pat. No. 3,552,591, patented Jan. 5, 1971, U.S. Pat. No. 3,760,969 patented Sept. 25, 1973. In particular, the second mentioned U.S. patent discloses, in addition to the use of the Teflon film, the provision of an annular groove formed on the surface area of the closure member, which faces the bead of the bottle mouth, for accommodating a liquid which leaks from the interior of the bottle and radially outwardly through the area of contact of the periphery of the Teflon film to the bead of the bottle mouth.

Although such a closure member available for use on a medical bottle, particularly a vial, may be generally satisfactory, it still has a problem when used under circumstances of reduced pressure, i.e., on a substantially vacuum-filled vial. A substantially vacuum-filled container is not a recent development and canned food industries have long manufactured, and are currently manufacturing, canned food products contained in substantially vacuum-filled cans. However, with a diversity of medicaments hitherto developed, pharmaceutical industries have recently marketed vacuum-filled vial products. Those suited for storage in vacuum-filled vials include, for example, some of the medicaments which tend to be pharmacologically inactivated when placed under the atmosphere and some powdery medicaments which are used to prepare an injection solution by injecting a liquid, such as distilled water, into the vial. Some of the medicaments which have hitherto been stored in vials with an inert gas filled therein may also be stored in vacuum-filled vials.

In any event, when the conventional closure member, such as disclosed in any one of the previously mentioned patents, is used on a vial which is either vacuum filled or filled with an inert gas and, therefore, requires a relatively high fluid-tightness to be established in such vial product, it has been found that fluid leakage takes place particularly during the manufacture of the vial product. This will now be discussed in detail.

In general, the vial product is manufactured by filling a required amount of medicament in a vial, then capping a closure member on the mouth of the vial, and finally cupping a metal sealing ring to clamp the closure member and the mouth of the vial together thereby to secure the closure member firmly and tightly to the vial. When it comes to products to be stored in a vacuum-filled vial or in a vial filled with an inert gas, the withdrawal of air from the vial or the injection of the inert gas into the vial is carried out after the filling of the medicament into the vial and before the capping of the closure member on the vial mouth. For a substantial period of time after the capping step before the subsequent cupping step, the vial with the closure member thereon is generally allowed to stand under the atmosphere in the form with the closure member having been not yet clamped tightly to the vial mouth by means of the metal sealing ring. It is during this period of time that the fluid leakage, i.e., escape of inert gas from the vial or intrusion of external air into the vial, is more likely to occur than at any other opportunities during the manufacture of the vial product. This is true even where the closure member has an annular leg integrally formed with the closure member and covered with the Teflon film for engagement into the vial mouth, such as disclosed in the last mentioned U.S. patent.

In view of the foregoing, it has been desired to provide a pierceable closure member which satisfies not only all of the existing requirements for the closure member on the medical vial to meet, such as resealability with no coring, inertness to chemicals, resistance to aging, inexpensiveness and others, but also a requirement concerning the capability of holding a fluid tightness particularly when the vial is evacuated to a predetermined degree of vacuum.

OBJECTS OF THE INVENTION

Accordingly, the present invention has for its essential object to provide an improved pierceable closure member for use on a medical vial which meets with the above discussed demand.

Another important object of the present invention is to provide an improved closure member of the type referred to above, which is effective to avoid any possible contamination and loss of a valuable medicament contained in the vial.

A further object of the present invention is to provide an improved closure member of the type referred to above, which is effective to retain the reduced pressure, i.e., substantial vacuum, inside the vial for a reasonably prolonged period of time even after the marketing.

SUMMARY OF THE INVENTION

According to the present invention, these and other objects can be accomplished by providing a pierceable closure member which comprises a generally disc-shaped rubber plug having a thickness generally within the range of 2 to 10 mm, preferably 2.5 to 5.0 mm, and made of any known butyl rubber including, for example, regular butyl rubber and halogenated butyl rubber. The rubber plug is integrally formed with an annular leg protruding a predetermined distance from one end surface of the rubber plug and also with an annular protrusion protruding a predetermined distance within the range of 0.1 to 3.0 mm, preferably 0.3 to 1.0 mm, from said one end surface in concentrical relation to the annular leg and positioned on an annular surface area which is delimited by the difference between the diameter of the rubber plug and the maximum outer diameter of the annular leg. The width of the annular protrusion as measured in a direction radially of the rubber plug may be about twice the distance over which the annular protrusion projects and is selected to be within the range of 0.2 to 6.0 mm, preferably 0.6 to 2.0 mm.

The closure member according to the present invention also comprises a lamina made of any known fluorocarbon resin such as tetrafluoroethylene resin, trifluorochloroethylene resin, tetrafluoroethylene-hexafluoropropylene copolymer, fluorovinylydene resin, fluorovinyl resin, ethylene-trifluorochloroethylene copolymer, perfluoroalkoxy resin, ethylene-tetrafluoroethylene copolymer or the like and having a film thickness within the range of 0.01 to 1.0 mm, preferably 0.03 to 0.3 mm. The lamina is in the form of a disc having a diameter smaller than the diameter of the rubber plug, but greater than the inner diameter of the vial mouth on which the closure member is to be used. This lamina has an annular recess defined therein in the shape conforming to and sufficient to accommodate the contour of the annular leg which, in cooperation with the annular recess, constitute a coated annular leg structure of the closure member. The coated annular leg structure of the closure member as a whole is adapted to be tightly engaged in the vial mouth when the closure member is used on the vial, and may have a maximum outer diameter within the range of 5.0 to 25.0 mm, an inner diameter within the range of 3.0 to 15.0 mm and a length within the range of 2.0 to 10.0 mm.

The lamina is secured to the rubber plug with the annular recess receiving the annular leg and has its peripheral edge portion embedded in the annular surface area of the plug in a depth equal to the film thickness of such lamina. The peripheral edge of the lamina may terminate either at a position radially inwardly of the annular protrusion or at a position within the annular protrusion. In either case, the annular peripheral edge portion of the lamina delimited by the difference between the diameter of the lamina and the maximum outer diameter of that portion of the lamina where the annular recess is defined must have a width sufficient to overlay the bead of the vial mouth when the closure member is used on the vial.

In order to achieve the intended object when and so long as the vial is evacuated to a vacuum of not higher than 200 Torr, the closure member according to the present invention must satisfy at least the following requirements.

1. The thickness of the rubber plug is within the range of 2 to 10 mm, preferably 2.5 to 5.0 mm.

2. The distance over which the annular protrusion projects from the end surface of the rubber plug is within the range of 0.1 to 3.0 mm, preferably 0.3 to 1.0 mm.

3. The width of the annular protrusion is within the range of 0.2 to 6.0 mm, preferably 0.6 to 2.0 mm.

4. The distance measured in the radial direction of the closure member from the boundary between the annular peripheral edge portion of the lamina and that portion of the lamina where the annular recess is defined to the innermost point of the annular protrusion which contacts the annular flat surface on the bead of the vial mouth is within the range of 1 to 10 mm.

5. The ratio of the distance, as defined in the item (2) above, relative to the distance as defined in the item (4) above is within the range of 0.1 to 0.5, preferably 0.13 to 0.25.

BRIEF DESCRIPTION OF THE DRAWINGS

These and other objects and features of the present invention will be better understood from the following detailed description of the present invention made in connection with preferred embodiments thereof with reference to the accompanying drawings, in which.

Before the description of the present invention proceeds, it is to be noted that like parts are designated by like reference numerals throughout the accompanying drawings.

DETAILED DESCRIPTION OF THE PREFERRED EMBODIMENTS

Figure 1:
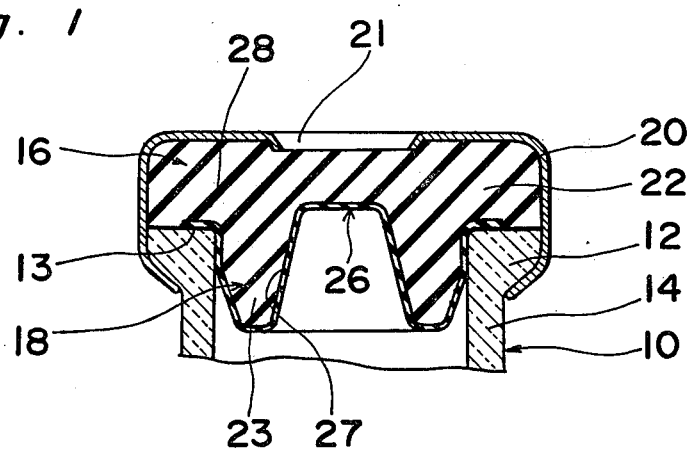
FIG. 1 is a side sectional view, on an enlarged scale, of the mouth of a medical vial closed by a closure member according to the present invention with a metal sealing ring secured thereto.

Referring first to FIG. 1, a medical vial 10 has a beaded, or flanged, mouth 12 having an access opening defined therein and continued to the body of the vial 10 through a neck 14. The vial mouth 12 also has an annular front face 13 which is made flat as is well known to those skilled in the art and which lies in a plane in flush with the plane of the access opening at the vial mouth 12. The vial mouth 12 is tightly closed by a closure member, generally identified by 16 and having an annular leg structure 18, with the annular leg structure 18 plugged into the vial mouth 12 through the access opening. The closure member 16 so mounted on the vial mouth 12 is firmly fastened thereto by a metal cup or cover 20 which is crimped at its bottom edge beneath the bead of the vial mouth 12. As is well known to those skilled in the art, the metal cup 20 is generally made of aluminum or the like soft metal and has an opening 21 defined therein in register with a central pierceable zone of the closure member 16. If desired, the metal cup 20 may have a tear-off tab (not shown) which is an integral part of the cup 20 before the medical vial product is used and which, when the vial 10 is to be used, can be torn off from the remainder of the cup 20 leaving the central opening 21 with the central pierceable zone of the closure member 16 consequently exposed to the outside in readiness for the access of a syringe needle, a cannula or the like.

The metal cup 20 is fitted in any known manner, for example, by means of a cupping machine forming a part of a known bottling apparatus, exteriorly around the respective peripheries of the vial mouth 12 and the closure member 16 to fasten the closure member 16 tightly and firmly to the vial mouth 12. This is generally done after the vial 10 has been filled with a single-dose or multiple-dose medicament and the closure member 16 has subsequently been plugged into the vial mouth 12 by means of a capping machine also forming a part of the known bottling apparatus, as is well known to those skilled in the art. However, when it comes to a vacuum-filled vial, the vial is subjected to an evacuating process under a substantially vacuum atmosphere to establish a substantially vacuum condition inside the vial 10. This evacuating process is carried out after the medicament has been filled in the vial, but before the closure member 16 is plugged into the vial mouth 12.

In view of, and for the purpose of substantially eliminating, the numerous problems inherent in the prior art closure members as hereinbefore discussed, the present invention is intended to provide the closure member particularly suited for use on the vacuum-filled vial, i.e., the vial evacuated to a vacuum of not higher than 200 Torr.

The details of the closure member 16 according to the present invention will now be described with particular reference to FIGS. 2 and 3.

The vial 10 having the closure member 16 thereon may be of any type made of glass or any other rigid material and may be a container for a solid or liquid medicament, or any other valuable solid or liquid material which is to be drawn out of the vial by sticking a syringe needle, a cannula or the like through the closure member 16 or to be stored for a prolonged period of time.

The closure member 16 generally comprises a generally disc-shaped rubber plug 22, made of any known butyl rubber including, for example, regular butyl rubber and halogenated butyl rubber, and a generally disc-shaped lamina 26 made of any known fluorocarbon resin such as hereinbefore listed and having a film thickness t within the range of 0.01 to 1.0 mm, preferably 0.03 to 0.3 mm.

The rubber plug 22 has a thickness T within the range of 2 to 10 mm, preferably 2.5 to 5.0 mm and a diameter D preferably within the range of 10.0 to 40.0 mm and is integrally formed with an annular leg 23 protruding a predetermined distance from one end surface of the rubber plug 22 in concentrical relation thereto and also with an annular protrusion 24 positioned exteriorly of and in concentrical relation to the annular leg 23. The annular protrusion 24 protrudes a predetermined distance H within the range of 0.1 to 3.0 mm, preferably 0.3 to 1.0 mm, from an annular surface area of the rubber plug 22 which is delimited by the difference between the diameter D of the rubber plug 22 and the maximum outer diameter of the annular leg 23.

The annular protrusion 24 protruding in the manner as hereinabove described has a width W within the range of 0.2 to 6.0 mm, preferably 0.6 to 2.0 mm. So far shown, the annular protrusion 24 is of a generally semicircular cross section with the distance H half the width W, but it may not be limited thereto and numerous combinations of the distance H and the width W are possible within the respective limited ranges.

Figure 4:
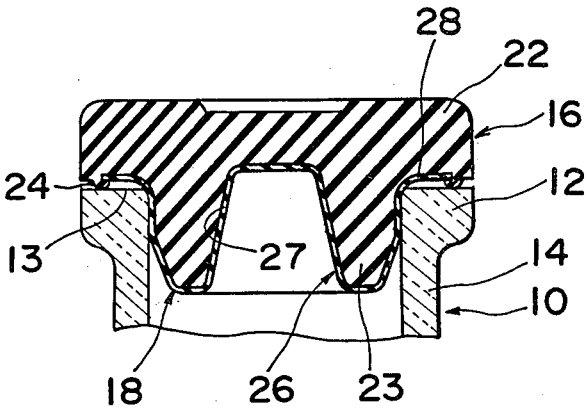
FIGS. 4 to 7 are views similar to FIG. 2, showing respective different embodiments of the present invention.

The lamina 26 has a diameter smaller than the diameter D of the rubber plug 22, but greater than the diameter of the access opening at the vial mouth 12 and also has an annular recess 27 defined therein in the shape conforming to and sufficient to accommodate the contour of the annular leg 23. This lamina 26 is secured to the rubber plug 22 with the annular recess 27 receiving therein the annular leg 23 in any known manner, e.g., by vulcanizing, with the use of a mold, a raw rubber material on a shaped film which has an inside surface chemically treated for securing adhesion between the rubber and the film. For example, for securing the lamina 26 to the rubber plug 23 to form the unitary closure member 12 having the annular leg structure 18, the alternative techniques disclosed in the previously mentioned U.S. patents may be employed. In the assembled condition, i.e., when and after the lamina 26 has been secured to the rubber plug 22 in the manner described above, a peripheral edge portion 28 of the lamina 26, which is delimited by the difference between the diameter of the lamina 26 and the maximum outer diameter $d_{out}$ of that portion of the lamina 26 where the annular recess 27 is defined (which diameter $d_{out}$ is preferably within the range of 5.0 to 25.0 mm), is substantially embedded in the annular surface area of the rubber plug 22 in a depth equal to the film thickness t. So far shown, the peripheral extremity of the lamina 26 is shown as terminating at a position spaced a distance radially inwardly from the annular protrusion 24, but may terminate at a position within the annular protrusion 24 as shown in FIG. 4.

In either case, the annular peripheral edge portion 28 of the lamina must have a width sufficient to overlay the bead of the vial mouth 12 when the closure member is used on the vial 10.

The minimum inner diameter $d_{in}$ and the length L of that portion of the lamina 26 where the annular recess 27 is defined may be within the range of 3.0 to 15.0 mm and within the range of 2 to 10 mm, respectively, but may not be limited thereto depending on the dimensions of the vial mouth 12. This is true of the maximum outer diameter $d_{out}$. It is, however, to be noted that the parameters $d_{out}$, $d_{in}$ and L represent or correspond to the maximum outer diameter, minimum inner diameter and length of the annular leg structure 18, respectively, of the unitary closure member 16 and, therefore, the former are to be understood as convertible with the latter.

For the purpose of the present invention, the annular protrusion 24 must be so positioned and so spaced from the annular leg structure 18 that the distance S between the innermost point P of contact of the annular protrusion 24 to the annular flat surface 13 on the bead of the vial mouth 12 and the point Q on the boundary between the annular peripheral edge portion 28 of the lamina and that portion of the lamina 26 where the annular recess 27 is defined, which distance S is measured in the radial direction of the closure member 16, must be within the range of 1 to 10 mm. while the ratio of the distance H relative to the distance S must be within the range of 0.1 to 0.5, preferably 0.13 to 0.25.

While the closure member according to the present invention is constructed as hereinbefore described, it is to be noted that the presence of the annular protrusion 24 contributes to the firm retention of the pressure-reduced atmosphere in the vial product. In particular, during the period after the capping step and before the subsequent cupping step, even though the closure member 16 has not yet been fastened firmly to the vial mouth 12, no intrusion of external air into the vial occur because, under the influence of the substantial vacuum inside the vial relative to the atmospheric pressure, the closure member can be drawn towards the vial mouth by the effect of the pressure differential with the annular protrusion 24 tightly contacting the annular flat surface 13 on the bead of the vial mouth 12. This advantage resulting from the employment of the annular protrusion 24 will be demonstrated by the following examples which are set forth only for the purpose of illustration and, therefore, are not intended to limit the scope of the present invention.

EXAMPLE I

Figure 2:
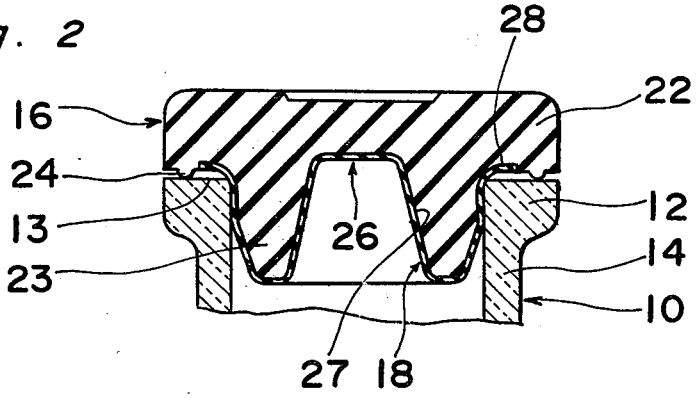
FIG. 2 is a side sectional view, on an enlarged scale, showing the closure member used on the vial mouth.
Figure 3:
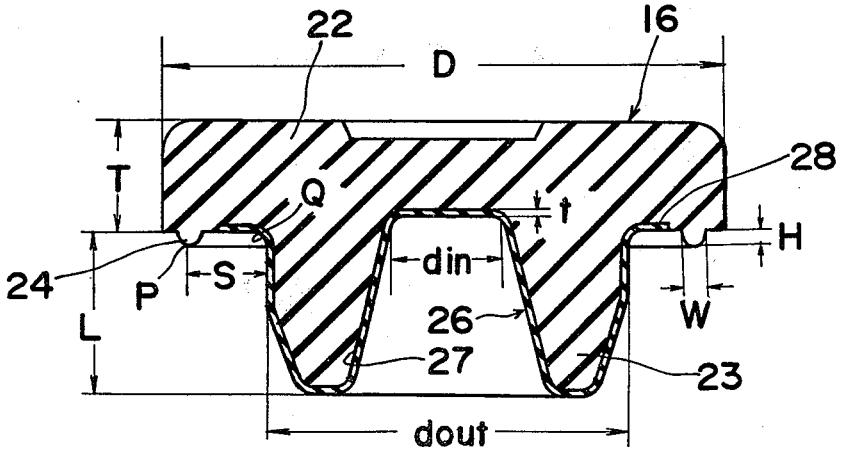
FIG. 3 is a side sectional view, on a further enlarged scale, showing the closure member shown in FIG. 2.

One hundred samples of the closure members of the present invention, each having a shape shown in FIG. 2 and having the following dimensions, were prepared:

| | | |
|---|---|---|
| D = 19.0 mm. | T = 3.0 mm. | L = 4.0 mm. |
| $d_{in}$ = 6.0 mm. | $d_{out}$ = 12.9 mm. | t = 0.1 mm. |
| H = 0.5 mm. | W = 1.0 mm. | S = 2.0 mm. |

For comparison, 100 samples of the prior art closure members each being of a construction disclosed in the U.S. Pat. No. 3,760,969 and having the same dimensions as those of the closure members of the present invention, but having no annular protrusion, were prepared.

All of the closure members according to the prior art and the present invention were used on vials having the vial mouth of 12.5 mm in inner diameter and 19.7 mm in outer diameter and having a 17 ml capacity. These vials were, after having loaded into a vacuum chamber, evacuated to 10 Torr and then capped with the closure members. 10 minutes after they had been removed out of the vacuum chamber, they were cupped with the metal sealing rings.

Subsequently, all of the samples were successively tested by piercing a syringe needle, fluid-coupled to a digital manometer, Model AA-2472 manufactured by Toyota Koki K.K. of Japan, through the respective closure members to determine the magnitude of vacuum remaining in those samples. Those samples having their degrees of vacuum exceeding 15 Torr were determined as having involved an air leakage and, therefore, rejected. The number of the rejected samples closed by the use of the closure members of the present invention were found to be zero whereas that closed by the prior art closure members were found to be 41 out of the 100 samples.

EXAMPLE II

Using the closure members of the following dimensions, vials having the vial mouth of 22.0 mm in inner diameter and 32.0 mm in outer diameter and having the same capacity as in Example I were closed by the same method as in Example I. The prior art closure members used had the dimensions which are identical to those of the closure members of the present invention used for this example, but had no annular protrusion:

| | | |
|---|---|---|
| D = 31.2 mm | T = 4.0 mm | L = 10.0 mm |
| $d_{in}$ = 13.0 mm | $d_{out}$ = 22.4 mm | t = 0.1 mm |
| H = 0.5 mm | W = 1.0 mm | S = 3.0 mm |

All of the samples were successively tested in the same method as in Example I and the result showed that the number of the rejected samples closed by the use of the closure members of the present invention was zero whereas that closed by the prior art closure members were 48 out of the 100 samples.

EXAMPLE III

For the purpose of showing how the ratio H/S affects the capability of the closure member of the present invention to maintain the vacuum in the vial, 27 samples of the closure members having, in addition to the following dimensions, respective combinations of the distance H of 0, 0.1, 0.2, 0.3, 0.4, 0.5 and 1.0 mm with the distance S of 1.0, 2.0, 3.0 and 4.0 mm were used on respective vials of 17 ml capacity and tested in the same manner as in Example I. Their other dimensions were:

| | | | |
|---|---|---|---|
| D = 19 mm | T = 3.0 mm | L = 4.0 mm | W = 1.0 mm |
| $d_{in}$ = 6.0 mm | $d_{out}$ = 12.9 mm | t = 0.1 mm | |

The results of the test are tabulated in the following table. In the table, the numerical values in the parentheses represent the respective ratios of the distance H relative to the distance S, that is, H/S.

| Distance H (mm) | Distance S (mm) 1 | 2 | 3 | 4 |
|---|---|---|---|---|
| 0 | Rejected | Rejected | Rejected | Rejected |
| 0.1 | Good (0.1) | Rejected | Rejected | Rejected |
| 0.2 | Good (0.15) | Good (0.1) | Rejected | Rejected |
| 0.3 | Good (0.2) | Excellent (0.15) | Good (0.1) | Rejected |
| 0.4 | Good (0.25) | Excellent (0.2) | Excellent (0.133) | Gcod (0.1) |
| 0.5 | Good (0.5) | Excellent (0.25) | Excellent (0.16) | Good (0.125) |
| 1.0 | — | Good (0.5) | Good (0.5) | Good (0.5) |

Figure 6:
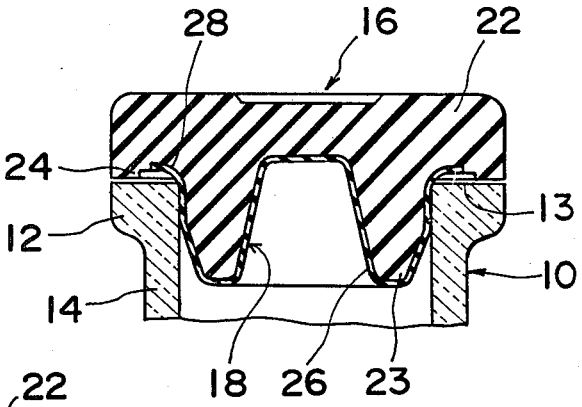
Figure 5:
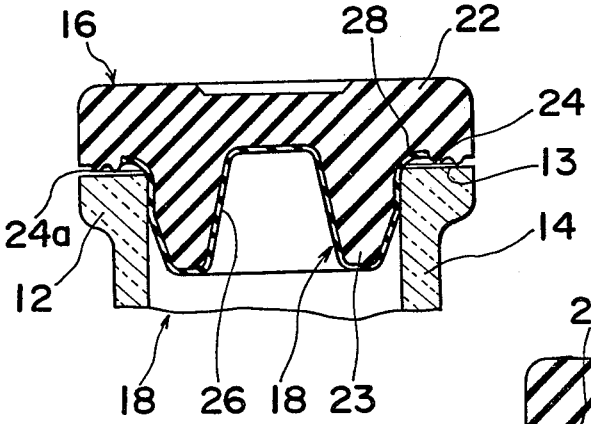
Figure 7:
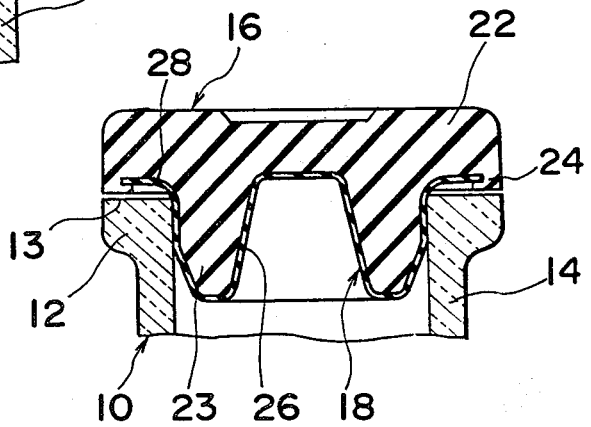

Although the present invention has fully been described in connection with the preferred embodiment thereof with reference to the accompanying drawings, it is to be noted that various changes and modifications are apparent to those skilled in the art. By way of example, an additional annular protrusion of generally semi-circular cross-section may be employed as shown by 24a in FIG. 5 radially externally of and concentrically with the annular protrusion 24. In addition, the annular protrusion 24 may not be limited to that having a generally semi-circular cross section, but may have a generally rectangular cross section as shown in FIGS. 6 and 7. The difference between the closure members shown respectively in FIGS. 6 and 7 lies in that, while the peripheral extremity of the lamina 26 shown in FIG. 6 is spaced from the annular protrusion 24, the same terminates within the annular protrusion 24 in FIG. 7.

Accordingly, such changes and modifications are to be understood as included within the true scope of the present invention unless they depart therefrom and, also, what is shown in FIG. 1 should not be construed as an actual representation of the state of the closure member fastened to the vial.

What is claimed is:

1. A pierceable closure member for use on a vacuum filled vial, which vial includes a beaded mouth having an annular flat face on the bead of the mouth, said closure member comprising a generally disc-shaped rubber plug made of butyl rubber and having an annular leg protruding from one end surface thereof in concentrical relation thereto and also an annular protrusion protruding from said one end surface thereof in concentrical relation to said annular leg, and a generally disc-shaped lamina made of fluorocarbon resin and having an annular recess defined therein, said lamina being secured to the rubber plug with the annular recess receiving the annular leg therein, said rubber plug having a thickness within the range of 2 to 10 mm, said annular protrusion having a width within the range of 0.2 to 6.0 mm and protruding a distance H within the range of 0.1 to 3.0 mm, said annular protrusion being so located on the annular surface area of the rubber plug, which is delimited by the difference between the diameter of the rubber plug and the maximum outer diameter of the annular leg, that the distance S between the point of contact of the annular protrusion to the annular flat face and the point on the boundary between the annular peripheral portion of the lamina, which is delimited by the difference between the diameter of the lamina and the maximum outer diameter of the annular portion of the lamina where the annular recess is defined, which distance S is measured in the radial direction of the closure member, is within the range of 1 to 10 mm, the ratio of the distance H relative to the distance S being within the range of 0.1 to 0.5.

2. A closure member as claimed in claim 1, wherein the annular protrusion is of a generally semi-circular cross section.

3. A closure member as claimed in claim 1, wherein the annular protrusion is of a generally rectangular cross section.

4. A closure member as claimed in claim 1, 2 or 3, wherein the peripheral extremity of the lamina is located at a position spaced a distance radially inwardly from the annular protrusion.

5. A closure member as claimed in claim 1, 2 or 3, wherein the peripheral extremity of the lamina is embedded in the annular protrusion.

6. A closure member as claimed in claim 1 or 2, wherein the rubber plug has an additional annular protrusion protruding from said one end surface at a position radially outwardly of the annular protrusion.

* * * * *